United States Patent [19]

Sato

[11] 4,407,918

[45] Oct. 4, 1983

[54] ELECTROPHOTOGRAPHIC PROCESS AND APPARATUS FOR MAKING PLURAL COPIES FROM A SINGLE IMAGE

[75] Inventor: Eiichi Sato, Hachioji, Japan

[73] Assignee: Olympus Optical Company Limited, Tokyo, Japan

[21] Appl. No.: 348,839

[22] Filed: Feb. 16, 1982

[30] Foreign Application Priority Data

Feb. 17, 1981 [JP] Japan ..... 56-20825

[51] Int. Cl.[3] ..... G03G 13/22

[52] U.S. Cl. ..... 430/54; 430/55; 430/57; 430/58; 430/65; 430/902; 430/49; 355/3 TR

[58] Field of Search ..... 430/42, 49, 31, 51, 430/54, 55, 58, 902, 65

[56] References Cited

U.S. PATENT DOCUMENTS 4,335,194 6/1982 Sakai ..... 430/42

*Primary Examiner*—John D. Welsh

*Attorney, Agent, or Firm*—Fleit, Jacobson & Cohn

[57] ABSTRACT

A photosensitive member is formed by applying on an electrically conductive substrate, a first photoconductive layer sensitive to a visible light, an insulating charge retentive layer, and a second photoconductive layer sensitive to ultraviolet light, successively in this order. At first the photosensitive member is uniformly charged to a negative polarity, while the photosensitive member is uniformly exposed to the visible light. Then an image of a document to be copied is projected while the photosensitive member is charged to a positive polarity. After that the photosensitive layer is uniformly exposed to the visible light and finally the photosensitive member is uniformly exposed to the ultraviolet light. In this manner, an electrostatic charge image having high contrast and resolution is formed in the photosensitive member by means of charges which are stably trapped across the charge retentive layer. By repeating development and transfer for the same and single charge image once formed in the photosensitive member a number of copies having excellent image quality can be printed.

52 Claims, 20 Drawing Figures

ELECTROPHOTOGRAPHIC PROCESS AND APPARATUS FOR MAKING PLURAL COPIES FROM A SINGLE IMAGE

BACKGROUND OF THE INVENTION

The present invention relates to an electrophotographic process and more particularly to a retention type electrophotographic process for forming a plurality of copies of a document from the same and single electrostatic charge image once formed on an electrophotographic photosensitive member.

There have been proposed various processes for forming a plurality of copies of a document. In one known process, a number of copies are duplicated from the same and single electrostatic charge image, which has been once formed on a photosensitive drum, by repeatedly effecting a development with toner and transfer of a toned image onto successive image receiving papers. Usually such a process is referred to as a retention type electrophotographic process. In such a process, in order to obtain a number of copies having good image quality, it is necessary to maintain stably for a long time the charge image once formed on the photoconductive drum. In known processes, since the latent image is composed of an electrostatic charge applied on an upper surface of the photosensitive member, the latent image might be decayed or deteriorated due to undesired escape of electrostatic charge through the toner or undesired injection of electrostatic charge via the image receiving papers from a biased transfer device. Therefore, the electrostatic charge image could not be retained stably on the photosensitive member during the duplication of a plurality of copies, and thus, it is difficult to obtain a duplicated image of good quality over a number of copies of the same document.

In order to avoid such a drawback, it has been known, from a Japanese Patent Application Laid-open Publication No. 54-72053, to use an electrophotographic photosensitive member 1 comprising an electrically conductive substrate 2, a charge retentive layer 3 made of insulating material and applied on the substrate, and a photoconductive layer 4 applied on the charge retentive layer as illustrated in FIG. 1. At first, a primary electrification of one polarity is effected by means of a corona charger 5 and at the same time the member 1 is irradiated uniformly as shown in FIG. 1A. This irradiation may be effected after the primary electrification. During this step, the charges are trapped across the charge retentive layer 3. Then, as illustrated in FIG. 1B, a secondary electrification of an opposite polarity is effected by means of a corona charger 6, while an image of a document to be duplicated is projected upon the photosensitive member 1. Then in an imagewise bright portion L, the charges are trapped across the charge retentive member 3, while in an imagewise dark portion D the charges are trapped across the photoconductive layer 4. Next, the uniform exposure is carried out to remove the charges trapped across the photoconductive layer 4 to form an electrostatic charge image as shown in FIG. 1C. This latent image is formed by only the charges trapped across the insulating charge retentive layer 3 and thus is hardly affected by the development and transfer so that a number of copies can be formed from the same and single latent image. However, in this known process, the edge of the image is liable to become obscure and it is difficult to form a latent image having sufficiently high contrast and resolution. The obscurity at the image edge is assumed to be introduced by the following mechanism. In the secondary electrification together with the imagewise projection shown in FIG. 1B, the positive charge on the free surface of the photoconductive layer 4 and the negative charge trapped in an interface between the photoconductive layer 4 and charge retentive layer 3 are cancelled out by means of carrier pairs generated in the photoconductive layer 4 due to the uniform exposure in FIG. 1C. During this process, as shown in FIG. 2, the carrier pairs 7 produced at the image edge are polarized and held along an irregular electric field 8. Therefore, in the bright portion L, the charge trapped in the interface between the charge retentive layer 3 and photoconductive layer 4 is equivalently spread towards the dark portion D. Further, the known photosensitive member 1 has a relatively thick photoconductive layer 4 and thus, the light image of the document is liable to become obscure.

Another known process for avoiding the obscurity at the image edge has been proposed in an Japanese Patent Application Laid-open Publication No. 55-43566. In this process, use is made of an electrophotographic photosensitive member 11 comprising an electrically conductive substrate 12, a charge retentive layer 13 applied on the substrate, an electrically insulating charge retentive member 14 applied on the layer 13 and a photoconductive layer 15 applied on the layer 14. The successive steps for forming the electrostatic latent image by means of the charges trapped across the insulating charge retentive layer 14 are the same as those shown in FIGS. 1A to 1C. In this process, the charges are trapped on one hand in an interface between the charge retentive layer 13 and insulating charge retentive layer 14 and on the other hand in an interface between the insulating charge retentive layer 14 and photoconductive layer 15, and thus the carrier pairs generated in the photoconductive layer 15 during the uniform exposing step shown in FIG. 1C are prevented from being spread laterally even if the irregular electric field is generated at the image edge. Therefore, the obscurity due to the spread of the charge carriers could be removed to some extent, but the obscurity due to the thick photoconductive layer 15 could not be solved at all.

SUMMARY OF THE INVENTION

The present invention has for its object to provide a novel and useful electrophotographic process which can avoid the obscurity of the image due to both the lateral spread of carrier parts and the thick photoconductive layer so as to form an electrostatic charge image having high contrast and resolution.

According to the present invention, an electrophotographic process for forming at least one copy of a document by means of an electrophotographic photosensitive member including an electrically conductive substrate, a first photoconductive layer applied on the substrate, a charge retentive layer made of electrically insulating material and applied on the first photoconductive layer, and a second photoconductive layer applied on the charge retentive layer, comprises the step of projecting an image of the document to be duplicated onto the photosensitive member with the aid of a first light to which the second photoconductive layer is substantially insensitive, but the first photoconductive layer is sensitive, while the photosensitive member is simultaneously charged;

the step of uniformly exposing the photosensitive member to said first light, said exposing step being effected after said image projecting step; and the step of uniformly exposing the photosensitive member to a second light to which said second photoconductive layer is sensitive, whereby an electrostatic charge image is formed in said photosensitive member by means of electrostatic charges trapped across said charge retentive layer.

The present invention also relates to an electrophotographic photosensitive member and has another object to provide a novel electrophotographic member which is preferably used in the electrophotographic process according to the invention.

According to the invention, an electrophotographic photosensitive member for use in the aforementioned electrophotographic process comprises an electrically conductive substrate, a first photoconductive layer applied on said substrate, a charge retentive layer made of electrically insulating material and applied on said first photoconductive layer, and a second photoconductive layer applied on said insulating charge retentive layer, said second photoconductive layer being substantially insensitive to a first light to which said first photoconductive layer is sensitive, but being sensitive to a second light.

DESCRIPTION OF THE PREFERRED EMBODIMENTS

Figure 1A:
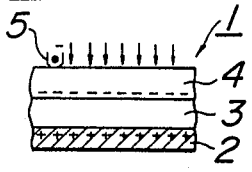
FIG. 1A PRIOR ART
FIGS. 1A to 1C are cross sectional views showing successive steps of a known electrophotographic process.
Figure 1B:
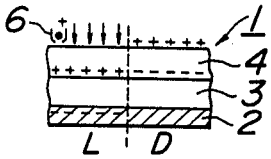
FIG. 1B PRIOR ART
Figure 1C:
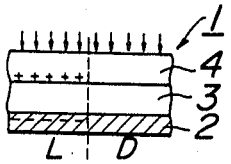
FIG. 1C PRIOR ART
Figure 2:
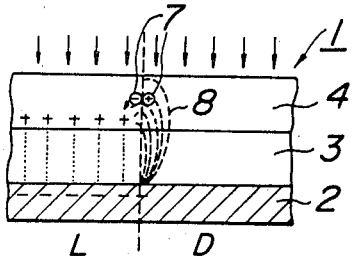
FIG. 2 PRIOR ART
FIG. 2 is a cross section for explaining how to generate an obscurity in the known process during the uniform exposure shown in FIG. 1C.
Figure 3:
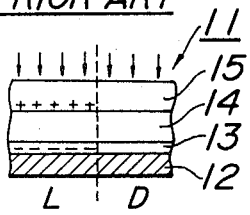
FIG. 3 PRIOR ART
FIG. 3 is a cross sectional view illustrating a known photosensitive member for use in another known electrophotographic process.
Figure 4:
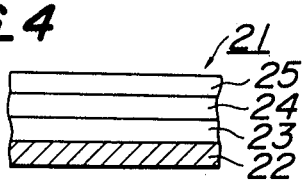
FIG. 4 is a cross section depicting the overall construction of a photosensitive member according to the invention.

FIG. 4 is a cross section showing the overall construction of an electrophotographic photosensitive member according to the invention. The photosensitive member 21 comprises an electrically conductive substrate 22, a first photoconductive layer 23 applied on the substrate 22, an electrically insulating charge retentive layer 24 applied on the first photoconductive layer 23, and a second photoconductive layer 25 applied on the charge retentive layer 24. The first and second photoconductive layers 23 and 25 are so constructed that they are selectively sensitive to first and second lights having different wavelengths or intensities.

For instance, the first photoconductive layer 23 may be made of photosensitive material which is sensitive to a visible light serving as the first light. Such material may be almost all substances which have been used in known photosensitive members. For instance, the first photoconductive layer 23 may be made of (1) an evaporated thin film of Se, Se alloy, CdS or amorphous silicon; (2) a thin film of fine grains of CdS, ZnO, TiO, etc. dispersed in organic resin or inorganic binder; (3) a thin film of organic photosensitive material such as polyvinylcarbazole (PVK); (4) a thin film of composite photosensitive material comprising a charge generating layer such as Se-Te, amorphous silicon and CdS, and a charge transferring layer such as PVK, parylene (trade name), anthracene, fluorene, polyvinyltetracene, 2,4,7-trinitro-9-fluorenone (TNF), dinitroanthracene and tetracyanopyrene.

The insulating charge retentive layer 24 may be formed by a polymer film such as fluorine-contained resin, polyester resin, polycarbonate resin, urethane resin, epoxy resin, polyethylene resin, cellulose acetate, and vinyl chloride resin, a polymer thin film made by glow discharge polymerization such as styrene, paraxylene, an inorganic thin film such as $SiO_2$, $Ta_2O_3$, or a parylene formed by thermal decomposition or gaseous phase polymerization of a dimer.

The second photoconductive layer 25 may be made of photoconductive material which is not substantially sensitive to the first light, i.e., visible light, but sensitive to ultraviolet light which is termed as the second light. The second photoconductive layer 25 may be made of organic photoconductive material such as PVK, organic pigment such as phthalocyanine dispersed in binder, or polymerized organic photoconductive material such as naphthalene thiophene formed by glow discharge polymerization.

As explained above, the first and second photoconductive layers 23 and 25 are formed by different kinds of photoconductive material sensitive to the first and second lights having different wavelengths, but according to the invention it is also possible to form these photoconductive layers from photoconductive material having different sensitivities to first and second lights having the same wavelength, but different intensities. For instance, the first and second photoconductive layers 22 and 25 have higher and lower sensitivities, respectively, and the first photoconductive layer 23 is activated by means of the first light having lower intensity and the second photoconductive layer 25 is activated by means of the second light having higher intensity. Further, the second photoconductive layer 23 may be made of photosensitive material having such a rectifying property that when the layer 23 is exposed to the first light and the electrification of one polarity is effected from the side of the second photoconductive layer 25, charge of opposite polarity is induced in an interface between the first photoconductive layer 23 and the charge retentive layer 24 and trapped therein.

As will be explained later, in the process according to the invention a projection of an image of a document and a uniform exposure are effected. The steps may be carried out by projecting the light from either side of the second photoconductive layer 25 and the conductive substrate 22. In the case of projecting the light from the second photoconductive layer 25 and using first and second lights having different wavelengths, the second photoconductive layer 25 and charge retentive layer 24 have to be permeable to the first light to which the first photoconductive layer 23 is sensitive. Preferably, the second photoconductive layer 25 and/or the insulating charge retentive layer 24 have a property to absorb the second light. In the case of using first and second lights having the same wavelength, the second photoconductive layer 25 and insulating charge retentive layer 24 should be permeable to the light.

On the other hand, when the projection of light is effected from the side of the substrate 22 and the first and second lights have different wavelengths, the substrate 22 should be permeable to the first and second lights and the first photoconductive layer 23 and insulating charge retentive layer 24 may be permeable to the second light to which the second photoconductive layer 25 is sensitive. Moreover, the first photoconductive layer 23 and/or the insulating charge retentive layer 24 preferably absorbs the first light. In the case of using first and second lights having the same wavelength, the substrate 22, the first photoconductive layer 23, and the insulating charge retentive layer 24 should be permeable to the light.

In an embodiment of the photosensitive member 21 according to the invention, the first photoconductive layer 23 is made by Se and an Se alloy having a thickness of 20μ, the insulating charge retentive layer 24 is made of a parylene film having a thickness of 4μ, and the second photoconductive layer 25 is made of a PVK film having a thickness of 2μ. The projection of light is to be effected from the side of the second photoconductive layer 25.

Figure 5A:
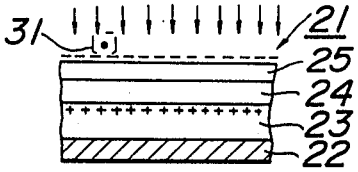
FIGS. 5A to 5D are cross sections showing successive steps of one embodiment of the electrophotographic process according to the invention.

FIGS. 5A to 5D are cross sections schematically showing successive steps of an embodiment of the electrophotographic process according to the invention. As shown in FIG. 5A, the photosensitive member 21 is primarily charged and is uniformly exposed to the first light denoted by solid arrows. These charging and uniform exposing steps may be effected simultaneously or successively in this order. The primary charging is carried out by a D.C. corona charger 31 and the surface of the second photoconductive layer is evenly applied with negative charge. To this end, a corona wire of the charge 31 is connected to a negative voltage. The visible first light having an intensity of about 50 Lux·Sec is uniformly projected. During this step, the first photoconductive layer 23 is exclusively activated and thus, a positive charge is trapped at the interface between the first photoconductive layer 23 and insulating charge retentive layer 24, and a negative charge is held on the free surface of the second photoconductive layer 25. Now it is assumed that the surface potential at this stage is equal to $V_1$.

Figure 5B:
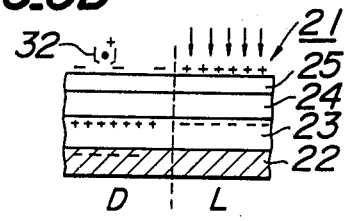

FIG. 5B illustrates a secondary charging and imagewise projection step. The secondary electrification may be conducted by means of a D.C. corona charger biased in the opposite polarity to that of the primary electrification, an A.C. corona charger, or an A.C. corona charger biased in a positive polarity. In the embodiment, a D.C. corona charger 32 of positive polarity is used to charge the member 21 to a positive polarity. Further, the imagewise projection may be effected by means of the first light having an intensity of about 10 Lux·Sec at an imagewise bright portion L. During this step, the first photoconductive layer 23 is locally activated in the imagewise bright portion L. That is to say, carrier pairs are induced in the interface between the first photoconductive layer 23 and insulating charge retentive layer 24 by means of the first light penetrating the second photoconductive layer 25 and insulating charge retentive layer 24 and the positive charge of the carrier pairs is carried away via the substrate under the influence of an electric field generated by the positive charge on the second photoconductive layer 25. In this manner only the negative charge is trapped in the interface between the first photoconductive layer 23 and insulating charge retentive layer 24. Therefore, the charges are held across the insulating charge retentive layer 24 and second photoconductive layer 25. The surface potential in the imagewise bright portion L is assumed to $V_{2L}$. In the imagewise dark portion D, the first photoconductive layer 23 remains highly resistive and serves as the insulating layer. Therefore, the positive charge trapped in the interface between the first photoconductive layer 23 and insulating charge retentive layer 24 could not move. A surface potential $V_{2D}$ in the dark area D is substantially equal to $V_{2L}$. This is due to the fact that the negative charge applied on the surface of second photoconductive layer 25 in the previous step is reduced or cancelled by the positive charge supplied by the corona charger 32 during the secondary electrification, and a negative charge is induced in the interface between the substrate 22 and first photoconductive layer 23.

Figure 5C:
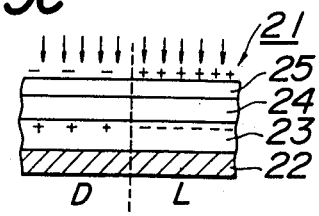

Next, the photosensitive member 21 is subjected to a uniform exposure of the first light as illustrated in FIG. 5C. During this uniform exposure, the first photoconductive layer 23 is activated, and thus the positive charge trapped in the interface between the first photoconductive layer 23 and insulating charge retentive layer 24 in the imagewise dark portion D is released to form an electrostatic charge image by means of the charges trapped across the retentive layer 24 and second photoconductive layer 25. In this case, in the bright portion L, a surface potential $V_{3L}$ is equal to $V_{2L}$, but in the dark portion D, a surface potential $V_{3D}$ becomes opposite in polarity to that in the bright portion L.

Figure 5D:
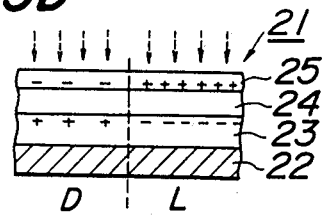

Finally, a uniform exposure of the second light is effected as shown in FIG. 5D. The second light (denoted by dotted arrows) may be ultraviolet light or light having a very strong intensity and to which the second photoconductive layer 25 is sensitive. Then the second layer 25 is activated and the charges on its surface are transferred into the interface between the second photoconductive layer 25 and charge retentive layer 24. In this manner, an electrostatic latent image is formed in the photosensitive member 21 by means of the charges trapped across the insulating charge retentive layer 24. A number of copies may be formed by repeating the development and transfer for the latent image thus formed. Since the electrostatic charges constituting the latent image are retained within the photosensitive member for a very long time without being affected by repeatedly effecting the development and transfer, a number of copies having excellent image quality can be obtained. After the desired number of copies have been duplicated, the latent image can be erased by simultaneously effecting the A.C. corona charging and uniform exposure with both the first and second lights.

Figure 6A:
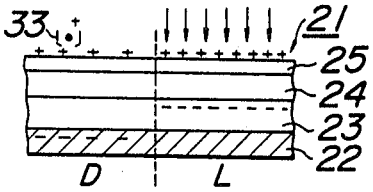
FIGS. 6A to 6D are cross sections illustrating successive steps of another embodiment of the electrophotographic process according to the invention.

FIGS. 6A to 6D show successive steps of another embodiment of the electrophotographic process according to the invention. In FIG. 6A, a primary electrification and an imagewise projection with the first light are carried out simultaneously. The primary electrification is effected by a D.C. corona charger 33 connected to a positive voltage source. During this step, the first photoconductive layer 23 is activated by the first light only in the imagewise bright portion L, and therefore the charges are held across the insulating charge retentive layer 24 and second photoconductive layer 25. In the imagewise dark portion D, the positive charge is held on the surface of second photoconductive layer 25 and the negative charge is held in the interface between the substrate 22 and first photoconductive layer 23. The amount of the charges in the bright area L is larger than that in the dark area D.

Figure 6B:
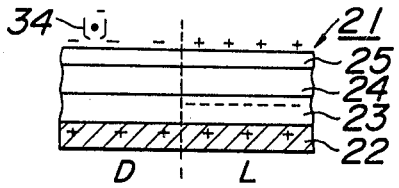

Then the photosensitive member 21 is subjected to a secondary electrification in dark area D as illustrated in FIG. 6B. The secondary electrification is effected by a D.C. corona charger 34 of opposite polarity to that of the primary electrification, i.e., negative polarity by means of the corona charger 33. This secondary electrification may be conducted by an A.C. corona charger or an A.C. corona charger biased negatively. During this step, the contrast of the electrostatic latent image formed by the previous step shown in FIG. 6A is not changed, but the surface potentials in the imagewise bright and dark portions L and D are varied.

Figure 6C:
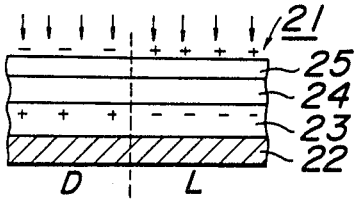
Figure 6D:
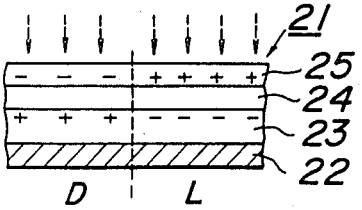

Then the uniform exposure of the first light is effected as depicted in FIG. 6C and finally the uniform exposure with the second light is carried out as illustrated in FIG. 6D. These steps are similar to those shown in FIGS. 5C and 5D in the previous embodiment.

By successively performing the steps illustrated in FIGS. 6A to 6D it is possible to form the electrostatic latent image by means of the charges trapped across the insulating charge retentive layer 24 within the photosensitive member 21.

It should be noted that the uniform exposure with the first light shown in FIGS. 5C and 6C and the uniform exposure with the second light illustrated in FIGS. 5D and 6D may be effected simultaneously or in an inverse order to that explained above.

Figure 7A:
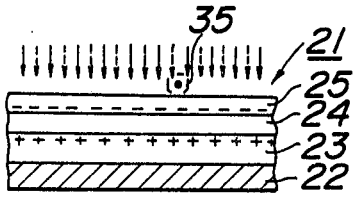
FIGS. 7A to 7C and FIGS. 8A to 8C are cross sections showing successive steps of still another embodiment of the electrophotographic process according to the invention.
Figure 7B:
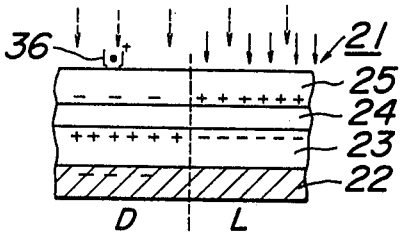
Figure 7C:
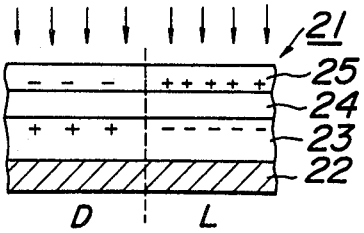

FIGS. 7A to 7C show successive steps of another embodiment of the electrophotographic process according to the invention. As illustrated in FIG. 7A, a primary electrification and a uniform exposure with both the first and second lights are first performed. The primary electrification and the uniform exposure may be effected successively in this order. In this embodiment, the primary charging of negative polarity is carried out by a D.C. corona charger 35. During this step both the first and second photoconductive layers 23 and 25 are activated, and thus a very large amount of the charges are trapped across the insulating charge retentive layer 24 because the capacitance constituted by the insulating charge retentive layer 24 is very large.

Next, the secondary electrification of positive polarity, the imagewise projection with the first light and the uniform exposure of the second light, are carried out simultaneously. The secondary electrification is effected by a D.C. corona charger 36 of positive polarity which is opposite to that of the primary electrification by means of the corona charger 35. During this step, since the uniform exposure with the second light is effected, the second photoconductive layer 25 is uniformly activated both in the bright and dark portions L and D, whilst the first photoconductive layer 23 is locally activated in the bright portion L. Therefore, in the imagewise bright portion L, the charge of opposite polarity to that of the previous step is trapped across the insulating charge retentive layer 24. In the imagewise dark portion D, since the first photoconductive layer 23 is not activated, the charge trapped in the interface between the first photoconductive layer 23 and insulating charge retentive layer 24 could not move and the negative charge trapped in the interface between the second photoconductive layer 23 and insulating charge retentive layer 24 is reduced by the positive charge of the secondary electrification. At the same time, the negative charge is induced in the interface between the substrate 22 and first photoconductive layer 23. In this manner, the surface potentials of the imagewise bright and dark portions L and D become substantially equal to each other.

Finally, the photosensitive member 21 is subjected to the uniform exposure with a first light as shown in FIG. 7C. During this step, the first photoconductive layer 23 is activated. Then the positive charge trapped in the interface between the first photoconductive layer 23 and insulating charge retentive layer 24 is released and the positive charge corresponding to the negative charge trapped in the interface between the insulating charge retentive layer 24 and second photoconductive layer 25 is trapped in the interface between the first photoconductive layer 23 and insulating charge retentive layer 24. In this manner the electrostatic latent image is formed by the charges trapped across the insulating charge retentive layer 24.

It should be noted that the uniform exposure with the second light shown in FIG. 7B may be effected after the secondary electrification or simultaneously with the uniform exposure with the first light illustrated in FIG. 7C.

Figure 8A:
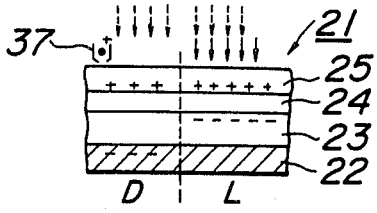
Figure 8B:
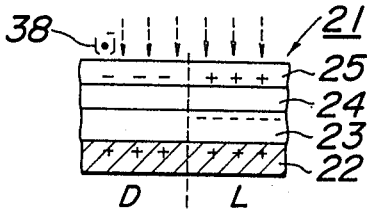
Figure 8C:
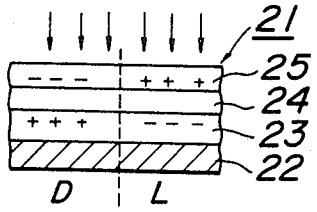

FIGS. 8A to 8C show successive steps of still another embodiment of the electrophotographic process according to the invention. As shown in FIG. 8A the photosensitive member 21 is subjected to a primary electrification, the imagewise projection with the first light and the uniform exposure with the second light. It should be noted that the uniform exposure with the second light may be effected subsequent to the primary electrification and imagewise projection. The primary electrification is effected by a D.C. corona charger 37 of positive polarity. During this step, the second photoconductive layer 25 is wholly activated by the uniform exposure with the second light, but the first photoconductive layer 23 is locally activated in the imagewise bright portion L. Therefore, in the imagewise bright portion L the charges are trapped across the insulating charge retentive layer 24 and in the imagewise dark portion D the positive and negative charges are trapped in the interface between the charge retentive layer 24 and second photoconductive layer 25 and in the interface between the substrate 22 and first photoconductive layer 23, respectively. The amount of the trapped charges in the bright portion L becomes greater than that in the dark portion D.

Next the member 21 is subjected to the secondary electrification and to the uniform exposure with the second light. The electrification and exposure may be effected simultaneously or successively in this order. The secondary electrification is carried out by a D.C. corona charger 38 of negative polarity which is opposite to that of the corona charger 37 for effecting the primary electrification. The secondary electrification may be effected by an A.C. corona charger or an A.C. corona charger biased negatively. During this step the second photoconductive layer 25 is wholly activated by the uniform exposure with the second light. Therefore, in the imagewise dark portion D the charges having opposite polarities to those trapped during the previous step shown in FIG. 8A are trapped in the interface between the insulating charge retentive layer 24 and second photoconductive layer 25, and in the interface between the substrate 22 and first photoconductive layer 23. In the imagewise bright portion L, since the first photoconductive layer 23 is not activated, the negative charge trapped in the interface between the layers 23 and 24 during the previous step could not move and the positive charge trapped in the interface between the layers 24 and 25 is reduced by the negative charge supplied by the corona charger 38. During this step the positive charge is induced in the interface between the substrate 22 and first photoconductive layer 23 and the surface potentials in the imagewise bright and dark portions L and D become substantially equal to each other.

Finally, the uniform exposure with the first light is effected as illustrated in FIG. 8C. During this step, in the bright portion L since the first photoconductive layer 23 is activated, the negative charge trapped in the interface between the layers 23 and 24 is released and the negative charge corresponding to the positive charge trapped in the interface between the layers 24 and 25 is trapped in the interface between the layers 23 and 24. In the imagewise dark portion D the positive charge trapped in the interface between the substrate 22 and first photoconductive layer 23 is moved into the interface between the layers 23 and 24 and is trapped therein. In this manner the electrostatic latent image consisting of the charges trapped across the insulating charge retentive layer 24 is formed.

Also in this embodiment, the uniform exposure with the second light shown in FIG. 8B may be performed after the secondary electrification or simultaneously with the uniform exposure with the first light shown in FIG. 8C.

In the above mentioned embodiments during the uniform exposure with the first light shown in FIGS. 5C, 6C, 7C and 8C, the carrier pairs are generated in the interface between the first photoconductive layer 23 and insulating charge retentive layer 24 due to the irradiation of the first light. Among these carriers the carriers having polarity opposite to that of the charge trapped in the interface between the first photoconductive layer 23 and insulating charge retention layer 24 are coupled with the charge trapped therein and the remaining carriers having the same polarity as that of the trapped charge are conducted away through the first photoconductive layer 23 which is made conductive into the substrate 22. Therefore, the carriers are not retained at the image edge and thus, the lateral spread of the charge in the interface between the layers 23 and 24 does not occur. Further, during the uniform exposure with the second light as shown in FIGS. 5D and 6D, the charges on the surface of second photoconductive layer 25 are attracted by the charge trapped in the interface between the layers 23 and 24 and thus do not spread laterally. Moreover, according to the invention the second photoconductive layer 25 does not serve as the main photoconductive member for forming the charge image, and thus it may be made relatively thin. As a result of the above mentioned effects according to the invention the obscurity of the charge image can be reduced materially. Further, the contrast and resolution of the charge image can be also made high. Further, since the charge image is stably trapped across the insulating charge retentive layer 24, the first photoconductive layer 23 may be made of material having lower resistance and higher sensitivity. In this manner, according to the invention, a number of copies having a good image quality can be formed from the same and single electrostatic latent image consisting of the charges trapped across the insulating charge retentive layer by repeating the developing and transferring.

It should be noted that the present invention is not limited to the embodiments explained above, but may be modified in various ways within the scope of the invention. For instance, in the above embodiments the secondary electrification is carried out by means of a D.C. corona charger, but it may be effected by a biased A.C. corona charger or by an A.C. corona charger. In case of use of an A.C. corona charger for the secondary electrification, in the embodiments shown in FIGS. 5 and 7 a charge image is formed consisting of the charges trapped across the insulating charge retentive layer 24 in the imagewise dark portion D, but in the embodiments illustrated in FIGS. 6 and 8, a negative charge image is formed consisting of the charges trapped across the insulating charge retentive layer 24 in the imagewise bright portion L. The first photoconductive layer 23 may be made of photosensitive material which is sensitive to the first light and has such a rectifying property that when the electrification is effected with a given polarity from the side of the second photoconductive layer 25, a charge of opposite polarity is induced in the interface between the layers 23 and 24 and is trapped therein. In such a case the uniform exposure with the first light shown in FIGS. 5A and 7A may be omitted. Furthermore, in the above embodiments the imagewise projection and uniform exposure are effected from the side of the second photoconductive layer 25, but they may be performed from the side of the substrate 22.

It should be further noted that as long as the uniform exposure with the second light is not effected simultaneously with the imagewise projection, the first photoconductive layer may be sensitive to the second light, and thus the first and second lights may have the same wavelength, but have different intensities. Contrary to this, when the uniform exposure with the second light is performed simultaneously with the imagewise exposure, the second photoconductive layer must be sensitive exclusively to the second light. Therefore, the second light must have a different wavelength from that of the first light.

As explained above in detail, according to the invention an electrostatic charge latent image having excellent resolution and contrast can be formed by the charges trapped across the insulating charge retentive layer. Therefore, the latent image is not directly affected by the developing and transferring, and thus the latent image can be retained stably for a very long time during which a number of copies of good image quality can be formed. Moreover, since the latent image is formed inside the photosensitive member, the developed toner image can be effectively transferred onto the record sheet with application of a relatively lower transfer bias voltage and the residual toner on the photosensitive member can be removed by a cleaning device each time after the transfer. Therefore, the developing agent can be prevented from being fatigued.

What is claimed is:

1. An electrophotographic process for forming at least one copy of a document by means of an electrophotographic photosensitive member including an electrically conductive substrate, a first photoconductive layer applied on the substrate, a charge retentive layer made of electrically insulating material and applied on the first photoconductive layer and a second photoconductive layer applied on the charge retentive layer, comprising the step of projecting an image of the document to be duplicated onto the photosensitive member with the aid of a first light to which the second photoconductive layer is substantially insensitive, but the first photoconductive layer is sensitive, while the photosensitive member is charged;

the step of uniformly exposing the photosensitive member to said first light, said exposing step being effected after said image projecting step; and the step of uniformly exposing the photosensitive member to second light to which said second photoconductive layer is sensitive, whereby an electrostatic charge image is formed in said photosensitive member by means of electrostatic charges trapped across said charge retention layer.

2. A process according to claim 1, further comprising prior to the image projecting step the step of charging the photosensitive member in one polarity and the step of uniformly exposing the photosensitive member to the first light.

3. A process according to claim 2, wherein said charging step in one polarity and the uniform exposing step with the first light are effected simultaneously.

4. A process according to claim 2, wherein said charging step in one polarity and uniform exposing step with the first light are effected successively in this order.

5. A process according to claim 2, wherein said charging effected simultaneously with the image projecting step is carried out by a D.C. corona charger of the other polarity.

6. A process according to claim 2, wherein said charging effected simultaneously with the image projecting step is performed by an A.C. corona charger.

7. A process according to claim 2, wherein said charging effected simultaneously with the image projecting step is performed by an A.C. corona charger biased in the other polarity.

8. A process according to claim 2, wherein said uniformly exposing step with the second light is effected after said uniformly exposing step with the first light.

9. A process according to claim 2, wherein said uniformly exposing step with the second light is effected simultaneously with said uniformly exposing step with the first light.

10. A process according to claim 2, wherein said uniformly exposing step with the second light is effected after the image projecting step, but prior to the uniformly exposing step with the first light.

11. A process according to claim 2, wherein said uniformly exposing step with the second light is effected simultaneously with the image projecting step.

12. A process according to claim 1, further comprising, after the image projecting step, but prior to the uniformly exposing step with the first light, a secondary charging step.

13. A process according to claim 12, wherein said secondary charging step is effected by a D.C. corona charger of polarity opposite to that of the charging carried out during the image projecting step.

14. A process according to claim 12, wherein said secondary charging step is carried out by an A.C. corona charger.

15. A process according to claim 12, wherein said secondary charging step is performed by an A.C. corona charger biased in polarity opposite to that of the charging effected during the image projecting step.

16. A process according to claim 12, wherein said uniformly exposing step with the second light is effected after said uniformly exposing step with the first light.

17. A process according to claim 12, wherein said uniformly exposing step with the second light is effected simultaneously with said uniformly exposing step with the first light.

18. A process according to claim 12, wherein said uniformly exposing step with the second light is effected after the secondary charging step, but prior to the uniformly exposing step with the first light.

19. A process according to claim 12, wherein said uniformly exposing step with the second light is effected simultaneously with the secondary charging step.

20. A process according to claim 12, wherein said uniformly exposing step with the second light is effected simultaneously with the image projecting step.

21. A process according to claim 1, further comprising, prior to the image projecting step, a step for primarily charging the photosensitive member.

22. A process according to claim 21, wherein the photosensitive member is exposed to the second light during said primary charging step.

23. A process according to claim 21, wherein said charging during the image projecting step is carried out by a D.C. corona charger of polarity opposite to that of the primary charging.

24. A process according to claim 21, wherein the charging during the image projecting step is effected by an A.C. corona charger.

25. A process according to claim 21, wherein the charging during the image projecting step is effected by an A.C. corona charger biased in polarity opposite to that of the primary charge.

26. A process according to claim 21, wherein said uniformly exposing step with the second light is effected after said uniformly exposing step with the first light.

27. A process according to claim 21, wherein said uniformly exposing step with the second light is effected simultaneously with said uniformly exposing step with the first light.

28. A process according to claim 21, wherein said uniformly exposing step with the second light is effected after the image projecting step, but prior to the uniformly exposing step with the first light.

29. A process according to claim 21, wherein said uniformly exposing step with the second light is effected simultaneously with the image projecting step.

30. A process according to any one of the preceding claims, wherein said first and second lights have different wavelengths.

31. A process according to claim 30, wherein said first light is visible light and said second light is ultraviolet light.

32. A process according to any one of claims 1 to 29, wherein said first and second lights have the same wavelength but have different intensities.

33. A process according to claim 1, further comprising a developing step for repeatedly developing the electrostatic charge image once formed in the photosensitive member with toner to form toned images and a transferring step for repeatedly transferring the toned images onto successive image receiving members to form a plurality of copies.

34. A process according to claim 1, wherein said image projecting step and the uniformly exposing steps with the first and second lights are effected from the side of the second photoconductive layer.

35. A process according to claim 1, wherein at least one of the image projecting step, the uniformly exposing step with the first light, and the uniformly exposing step with the second light is effected from the side of the conductive substrate.

36. An electrophotographic photosensitive member for use in an electrophotographic process according to claim 1, comprising a substrate made of electrically conductive material;

a first photoconductive layer applied on said conductive substrate;

a charge retentive layer made of electrically insulating material and applied on said first photoconductive layer; and a second photoconductive layer applied on said charge retentive layer which is substantially insensitive to the first light to which the first photoconductive layer is sensitive.

37. A photoconductive member according to claim 36, wherein said first and second photoconductive layers are exclusively sensitive to the first and second lights, respectively.

38. A photosensitive member according to claim 36, wherein said first photoconductive layer is sensitive both to the first and second lights.

39. A photosensitive member according to claim 36, wherein said first photoconductive layer has a rectifying property in which a charge of given polarity can freely move through the first photoconductive layer while it is dark.

40. A photosensitive member according to claim 36, wherein said first photoconductive layer is formed by an evaporated film of material selected from the group consisting of Se, Se alloy, CdS and amorphous silicon.

41. A photosensitive member according to claim 36, wherein said first photoconductive layer is formed by dispersing in a solution fine grains of material selected from the group consisting of CdS, ZnO and TiO.

42. A photosensitive member according to claim 36, wherein said first photoconductive layer is made of polyvinylcarbazole.

43. A photosensitive member according to claim 36, wherein said first photoconductive layer is formed by a composite photoconductive layer including a charge generating layer made of material selected from the group consisting of Se-Te, amorphous silicon, and CdS, and a charge transferring layer made of material selected from the group consisting of polyvinylcarbazole, parylene, anthracene, fluorene, polyvinyltetracene, 2,4,7-trinitro-9-fluorenone, dinitroanthracene and tetracyanopyrene.

44. A photosensitive member according to claim 36, wherein said charge retentive layer is formed by a polymer film made of material selected from the group consisting of fluorine-containing resin, polyester resin, polycarbonate resin, urethane resin, epoxy resin, polyethylene resin, cellulose acetate, and vinyl chloride resin.

45. A photosensitive member according to claim 36, wherein said charge retentive layer is formed by a polymer film made by glow discharge polymerization of material selected from a group consisting of styrene and para-xylene.

46. A photosensitive member according to claim 36, wherein said charge retentive member is formed by an inorganic thin film of material selected from the group consisting of $SiO_2$ and $Ta_2O_3$.

47. A photosensitive member according to claim 36, wherein said charge retentive member is formed by a thin film of p-xylene resin obtained by thermal decomposition of a dimer.

48. A photosensitive member according to claim 36, wherein said charge retentive layer is formed by a thin film of p-xylene obtained by gas phase polymerization.

49. A photosensitive member according to claim 36, wherein said second photoconductive layer is formed by a thin film of polyvinylcarbazole.

50. A photosensitive member according to claim 36, wherein said second photoconductive layer is formed by dispersing organic pigment in a binder.

51. A photosensitive member according to claim 50, wherein said organic pigment is phthalocyanine.

52. A photosensitive member according to claim 36, wherein said second photoconductive layer is formed of a thin film of naphthalene thiophene obtained by glow discharge polymerization.

* * * * *